166-250 SR
FIP8011 XR 4,132,268

United States Patent [19]

Harrison, deceased

[11] 4,132,268

[45] Jan. 2, 1979

[54] METHOD FOR INSURING OIL WELL TREATMENT ON A REGULAR BASIS AS SCHEDULED

[75] Inventor: Robert J. Harrison, deceased, late of Hominy, Okla., by Carmen H. Shannon, executrix

[73] Assignee: Texaco Inc., New York, N.Y.

[21] Appl. No.: 860,346

[22] Filed: Dec. 14, 1977

Related U.S. Application Data

[63] Continuation-in-part of Ser. No. 733,659, Oct. 18, 1976, abandoned.

[51] Int. Cl.[2] ..... E21B 43/00; E21B 43/24

[52] U.S. Cl. ..... 166/244 C; 166/250; 166/53; 166/64; 166/75 R

[58] Field of Search ..... 166/53, 250, 64, 67, 166/68, 75, 244 C, 305 R, 279, 310, 312

[56] References Cited

U.S. PATENT DOCUMENTS

| | | | |
|---|---|---|---|
| 2,089,035 | 8/1937 | Oberlin | 166/310 |
| 2,194,616 | 3/1940 | Schoeneck | 166/267 X |
| 2,688,368 | 9/1954 | Rodgers et al. | 166/267 |
| 2,773,551 | 12/1956 | Warden et al. | 166/75 |
| 2,884,067 | 4/1959 | Marken | 166/75 |
| 3,053,320 | 9/1962 | Steincamp | 166/75 X |
| 3,171,485 | 3/1965 | White, Jr. | 166/64 |
| 3,211,225 | 10/1965 | Thiessen et al. | 166/75 |
| 3,223,167 | 12/1965 | Hampton | 166/75 |
| 3,228,472 | 1/1966 | Rhoads, Jr. | 166/75 X |
| 3,710,867 | 1/1971 | Bansbach | 166/75 X |

*Primary Examiner*—Stephen J. Novosad
*Attorney, Agent, or Firm*—Carl G. Ries; Thomas H. Whaley; Theron H. Nichols

[57] ABSTRACT

A method is disclosed for insuring oil well treatment as with a corrosion inhibitor, for example, with a precise slug of a chemical on a regular basis comprising, briefly, repeatedly and precisely ejecting precisely spaced apart consecutive predetermined slugs of a chemical to the oil well by operating a first valve responsive to a first timer, and repeatedly and precisely ejecting a predetermined precise slug of a flush liquid behind each chemical slug by operating a second valve responsive to a second timer for insuring oil well chemical treatment on a regular basis as scheduled and for eliminating personnel time required for manually flushing each chemical slug throughout the oil well for an extended period of time.

13 Claims, 1 Drawing Figure

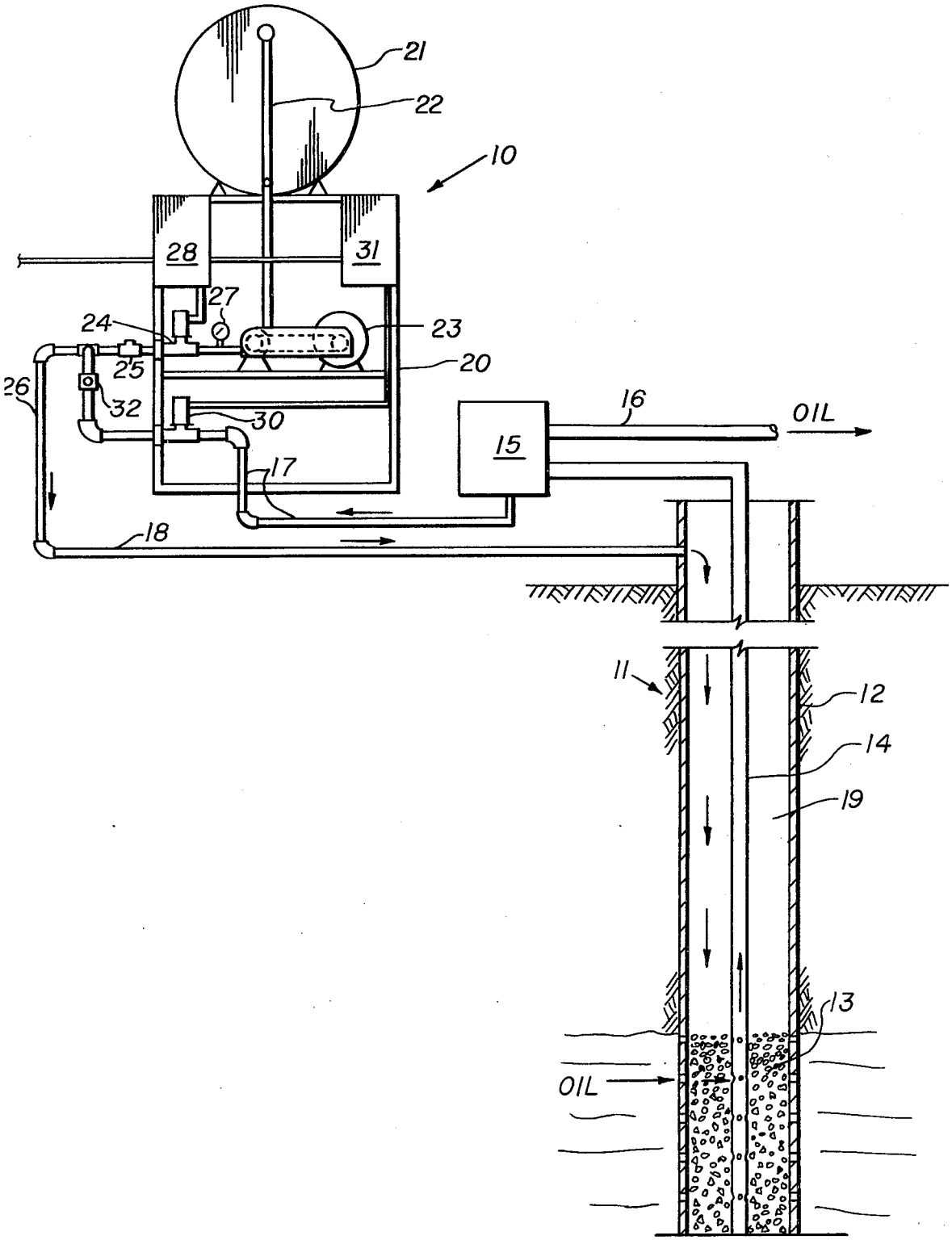
21
22
10
28
31
27
24
23
25
20
26
32
30
16
OIL
15
17
18
11
12
14
19
13
OIL

METHOD FOR INSURING OIL WELL TREATMENT ON A REGULAR BASIS AS SCHEDULED

BACKGROUND OF THE INVENTION

This is a continuation-in-part of my prior U.S. Pat. application Ser. No. 733,659, filed Oct. 18, 1976, now abandoned.

It is often desired and necessary to periodically treat producing wells with corrosion inhibitors or other types of treating chemicals. This regular treating of the well may comprise pouring a chemical from a tank of the chemical, such as the corrosion inhibitor, through a conduit into a well, and manually measuring a slug of the chemical to the well. Immediately thereafter a flush fluid as a slug of higher pressure flush liquid, as water under pressure, from a suitable source must be measured out for pushing the slug of chemical to and throughout the well for treating the well, as coating all internal surfaces of the well casing and tubing with the corrosion inhibitor. This treatment must be done on a regular basis as scheduled, as once a week, if not sooner, for months and months on end, on many very remotely located wells. The personnel required to operate this oil well periodic corrosion inhibitor treatment, for example, with any degree of reliability, comprises a substantial investment and logistics problem.

A new method has been invented for insuring well treatment on a regular basis as scheduled and for eliminating personnel time required for manually flushing slugs of a chemical throughout a well for an extended period of time.

OBJECTS OF THE INVENTION

Accordingly a principal object of this invention is to provide a method for insuring chemical well treatment on a regular basis as scheduled.

A further primary object of this invention is to provide a method for providing a chemical well treatment that eliminates personnel time required for manually and precisely flushing precise slugs of chemical throughout a well for an extended period of time.

A further object of this invention is to provide a method for treating a well on a regular basis as scheduled and for eliminating personnel time required for manually flushing precise slugs of a chemical throughout a well for an extended period of time that is easy to operate, is of simple configuration, is economical to operate, and is of greater efficiency in the chemical treatment of wells.

Other objects and various advantages of the disclosed method for chemically treating a well will be apparent from the following detailed description, together with the accompanying drawing of at least one embodiment for performing the method, submitted for purposes of illustration only and not intended to define the scope of the invention, reference being made for that purpose to the subjoined claims.

BRIEF DESCRIPTION OF THE DRAWING

The drawing diagrammatically illustrates by way of example, not by way of limitation, one form of a mechanism for carrying out the method of the invention in which:

The FIGURE is a schematic diagrammatic vertical sectional view of a mechanism for performing the method of chemical treating a well.

The invention disclosed herein, the scope of which being defined in the appended claims is not limited in its application to the details of construction and arrangement of parts shown and described since the invention is capable of other embodiments and methods and of being practiced or carried out in various other ways. Also, it is to be understood that the phraseology or terminology employed here is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

DESCRIPTION OF THE METHODS

Briefly, a basic method for insuring oil well chemical treatment on a regular basis as scheduled and for eliminating personnel time comprises the steps of, 1. repeatedly ejecting precisely spaced apart consecutive predetermined precise slugs of a chemical to an oil well by operating a first valve, and 2. repeatedly ejecting a predetermined precise slug of a flush liquid directly behind and contiguous with each chemical slug for pushing that chemical slug in to the well by operating a second valve for insuring oil well chemical treatment on a regular basis as scheduled and for eliminating personnel time required for manually flushing each chemical slug throughout the oil well for an extended period of time.

A more detailed basic method for well treatment comprises the following steps:

1. repeatedly and precisely opening a first valve responsive to a first timer for ejecting spaced apart consecutive precise slugs of the chemical to an injection line for delivery to a well, as a slug of corrosion inhibitor chemical.

2. precisely opening the first valve responsive to the first timer for precisely spacing each chemical slug from the next consecutive chemical slug by a precise predetermined period of time, 3. repeatedly and precisely opening a second valve responsive to a second timer for repeatedly ejecting spaced apart consecutive slugs of a flush liquid into the injection line, one flush slug directly behind and contiguous with each chemical slug, the flush liquid in this case being taken from the production fluids, as the water form an oil-water separator at the surface near the well, and 4. precisely opening the second valve responsive to the second timer for precisely spacing each flush liquid slug directly behind a chemical slug and spaced from the next consecutive flush liquid slug by a predetermined precise period of time for insuring well treatment on a regular basis as scheduled and for eliminating personnel time required for manually flushing each chemical slug throughout the well for an extended period of time.

A more detailed method for well treatment comprises the following steps of, 1. pumping a chemical into an injection line for delivery to the oil well, 2. measuring out a precise slug of the chemical to the injection line with a first valve, 3. controlling the first valve with a first timer for opening the first valve for a precise period of time for ejecting a precise slug of the chemical to the injection line for delivery to the well, 4. flushing a high pressure flush liquid to the injection line for circulating the chemical slug throughout the well;

5. measuring out a precise amount of flush liquid to the injection line for delivery to the well with a second valve, and 6. controlling the second valve with a second timer for opening the second valve for a precise period of time for ejecting a precise amount of flush liquid to the injection line or slug directly behind and contiguous with the slug of chemical for circulating the chemical slug throughout the well for insuring well treatment on a regular basis as scheduled and for eliminating personnel time required for manually flushing slugs of the chemical throughout a well for an extended period of time.

More details of the above method steps are given below.

The first method step of pumping comprises, 1. pumping the chemical from a tank of the chemical to the first valve for delivery to the injection line for ejection into the oil well.

The first method step of measuring comprises, 1. measuring out a precise slug of the chemical from the pump with the first valve for injection into the injection line for delivery to the oil well.

The method step of controlling the first valve comprises, 1. controlling the first valve with the first timer connected thereto for opening the first valve for a precise period of time for ejecting a precise slug of the chemical to the injection line for delivery to the oil well.

The method step of flushing comprises, 1. flushing a flush liquid from a pressure source of flush liquid to the flush line for supplying flush liquid under pressure to the injection line for circulating the chemical slug throughout the oil well.

The second method step of measuring comprises, 1. measuring out a precise amount of flush liquid to the flush line by the second valve for controlling the injection of the flush liquid into the injection line for circulating the chemical slug throughout the oil well.

The method step of controlling the first valve comprises, 1. controlling the first valve with the first timer connected thereto for repeatedly opening the first valve for precise periods of time for ejecting spaced apart consecutive precise slugs of the chemical to the injection line for delivery to the well, and 2. further controlling the first valve with the first timer for spacing each slug of the chemical from the next consecutive slug by a predetermined precise period of time for insuring well treatment on a regular basis as scheduled and for eliminating personnel time required for manually ejecting the precise slugs of the chemical to the well for an extended period of time.

The method step of controlling the second valve comprises, 1. controlling the second valve with a timer connected thereto for opening the second valve for a precise period of time for ejecting a precise amount of flush liquid to the injection line directly behind the chemical slug for circulating the chemical slug throughout the oil well for insuring well treatment on a regular basis as scheduled and for eliminating personnel time required for manually flushing slugs of the chemical throughout the oil well for an extended period of time.

A more detailed method step of controlling the second valve comprises, 1. controlling the second valve with the second timer connected thereto for repeatedly ejecting spaced apart consecutive slugs of flush liquid into the injection line, one flush liquid slug for each chemical slug, and 2. additionally controlling the second valve with the second timer for spacing each of the slugs of flush liquid directly behind each chemical slug and spacing each consecutive chemical slug by a predetermined precise period of time for insuring well treatment on a regular basis as scheduled and for eliminating personnel time required for manually flushing each slug of the chemical throughout the well for an extended period of time.

THE PREFERRED EMBODIMENT FOR PRACTICING THE INVENTION

Methods for chemical treating an oil well may be performed by other mechanisms than that disclosed in the FIGURE. The mechanism disclosed herein may be operated by other methods than those disclosed, as by hand. However, the preferred system for performing the method is disclosed in the FIGURE.

The FIGURE is a vertical sectional view illustrating the chemical feeder system 10 for treating a producing oil well 11.

The oil well 11 is a conventional producing oil well having a casing 12 perforated at the bottom for oil to pass through it, the gravel pack 13, and perforated production tubing 14 to the surface. Here the oil passes through a separator 15 from which oil is bled off in oil line 16 and water is bled off to a flush line 17. Injection line 18 from the chemical feeder 10 injects chemical slugs as pushed forward by slugs of wash liquid down into an annulus 19 in the well.

While this invention is particularly conceived and designed to use with oil and gas wells, with changes and additions it possibly may be adapted and used with other wells.

The chemical feeder system 10 includes a steel rack 20 for supporting a 55 gallon (209 liters) chemical tank 21, for example, with sight glass 22 for supplying the chemical to a ⅓ horsepower electric pump 23. The chemical or chemicals from the pump pass through a conventional quick acting or ½ inch motor snap valve, as a solenoid valve 24, and then through check valve 25 to injection line 26 which injects the chemicals into the well 10. A pressure gauge 27 is connected in the line between the pump 23 and the valve 24. A timer or electric clock 28 is connected to valve 24 for metering out a predetermined precise amount or slug of chemicals, as a corrosion inhibitor, for the well every seven days, for example.

A flush line 29 supplies a predetermined precise slug of flush liquid to the injection line 26 for pushing and carrying the chemical slug through the injection line to the well 11 for treating the well, as by coating all internal surfaces thereof with the corrosion inhibitor. This precision slug of flush liquid is metered from the flush line by a conventional quick action or solenoid or ½ inch motor snap valve 30 controlled by a second timer or 7-day electric clock 31 mounted on the steel rack 20. Check valves 25 and 32 prevent any back flow of flush liquid or chemical in the injection line or the flush line, respectively.

While the flush line is illustrated as being supplied with water from the oil-water separator 15, it may be supplied from any other suitable source.

Likewise, while the flush in the disclosed system comes from a separate line, it may emerge from the chemical feeder system already mixed with the chemical for being transported through the ejection line to the well. In the illustrated example, the flush may circulate the chemical or chemicals from one to twenty four hours, as required, on any one or more days each week.

Thus, with the above described well treating system, the disclosed method may be practiced to insure that wells will be treated on a regular basis as scheduled and that unnecessary personnel time will be eliminated, particularly, for example, for "batch" type treatment.

Thus, accordingly, it will be seen that the present method for insuring oil well treatment on a regular basis as scheduled will be performed in a manner which meets each of the objects set forth hereinbefore.

While only one method and one embodiment for performing the method of the invention has been disclosed, it will be evident that various other methods and modifications are possible in the disclosed method of oil well chemical treatment without departing from the scope of the invention, and it is accordingly desired to comprehend within the purview of this invention such modifications as may be considered to fall within the scope of the appended claims.

I claim:

1. A method for insuring oil well treatment on a regular basis as scheduled and for eliminating personnel time required for manually flushing slugs of a chemical throughout an oil well for an extended period of time comprising the steps of, a. repeatedly and precisely opening a first valve for ejecting a slug of the chemical to an injection line for delivery to a well, b. precisely closing the first valve for a precise predetermined period of time for measuring the precise amount of chemical for forming the chemical slug, c. precisely opening a second valve upon closing of the first valve for ejecting a slug of a flush liquid into the injection line directly behind and contiguous with the chemical slug for pushing it into the well, and d. repeating the above three steps for precisely spacing each consecutive chemical slug pushed by a flush liquid slug by a predetermined precise period of time for insuring well treatment on a regular basis as scheduled and for eliminating personnel time required for manually flushing each chemical slug throughout the well for an extended period of time.

2. A method as recited in claim 1 wherein the method step of opening the second valve comprises, a. controlling the second valve with a timer connected thereto for opening the second valve upon closing of the first valve for a precise period of time before closing for ejecting a precise amount of flush liquid to the injection line directly behind and contiguous with the chemical slug for circulating the chemical slug throughout the oil well for insuring well treatment on a regular basis as scheduled and for eliminating personnel time required for manually flushing slugs of the chemical throughout the oil well for an extended period of time.

3. A method as recited in claim 2 wherein the method step of pumping comprises, a. pumping the chemical from a tank of the chemical to the first valve for delivery to the injection line for ejection into the oil well.

4. A method as recited in claim 2 wherein the second method step comprises, a. measuring out a precise slug of the chemical from the pump with the first valve for injection into the injection line for delivery to the oil well.

5. A method as recited in claim 2 wherein the method step of controlling the first valve comprises, a. controlling the first valve with the first timer connected thereto for opening and closing the first valve for a precise period of time for ejecting a precise slug of the chemical to the injection line for delivery to the oil well.

6. A method as recited in claim 2 wherein the method step of flushing comprises, a. flushing a flush liquid from a pressure source of flush liquid to the flush line for supplying flush liquid under pressure to the injection line for circulating the chemical slug throughout the oil well.

7. A method as recited in claim 2 wherein the method step of controlling the first valve comprises, a. controlling the first valve with the first timer connected thereto for repeatedly opening and closing the first valve for precise periods of time for ejecting spaced apart consecutive precise slugs of the chemical to the injection line for delivery to the well, and b. further controlling the first valve with the first timer for spacing each slug of the chemical from the last consecutive slug by a predetermined precise period of time for insuring well treatment on a regular basis as scheduled and for eliminating personnel time required for manually ejecting the precise slugs of the chemical to the well for an extended period of time.

8. A method as recited in claim 1 wherein the method step of opening the second valve comprise, a. controlling by precisely opening the second valve upon closing of the first valve with a second timer connected thereto for ejecting a slug of flush liquid into the injection line directly behind and contiguous with the chemical slug, and b. additionally controlling by closing the second valve with the second timer after a predetermined period of time for measuring the precise amount of flush liquid for the slug of flush liquid directly behind the chemical slug for insuring well treatment on a regular basis as scheduled and for eliminating personnel time required for manually flushing each slug of the chemical throughout the well for an extended period of time.

9. A method for insuring oil well treatment on a regular basis as scheduled and for eliminating personnel time required for manually flushing slugs of a chemical throughout an oil well for an extended period of time comprises the steps of, a. pumping a chemical through a first valve into an injection line for delivery to the oil well, b. controlling the first valve with a first timer for opening and closing the first valve for a precise period of time for ejecting a precise slug of the chemical to the injection line for delivery to the well, c. flushing a high pressure flush liquid through a second valve to the injection line for circulating the chemical slug throughout the well, and d. controlling the second valve with a second timer for opening the second valve upon closing of the first valve for a precise amount of flush liquid to the injection line directly behind and contiguous with the chemical slug for circulating the chemical slug throughout the well for insuring well treatment on a regular basis as scheduled and for eliminating personnel time required for manually flushing slugs of the chemical through a well for an extended period of time.

10. A method for insuring oil well chemical treatment on a regular basis as scheduled and for eliminating personnel time comprising the steps of, a. repeatedly and precisely opening and closing a first valve responsive to a first timer for repeatedly ejecting precisely spaced apart consecutive predetermined precise slugs of a chemical to an oil well, and b. precisely opening a second valve upon closing of the first valve responsive to a second timer for ejecting a predetermined precise slug of flush liquid directly behind and contiguous with the chemical slug for pushing that chemical slug into the well for insuring oil well chemical treatment on a regular basis as scheduled and for eliminating personnel time required for manually flushing each chemical slug throughout the oil well for an extended period of time.

11. A method for insuring a corrosion inhibitor oil well treatment on a regular basis as scheduled and for eliminating personnel time required for manually flushing slugs of a corrosion inhibitor throughout an oil well for an extended period of time comprising the steps of, a. repeatedly ejecting precisely spaced apart consecutive predetermined precise slugs of corrosion inhibitor to an oil well by opening and closing a first valve responsive to a first timer, and b. repeatedly ejecting a predetermined precise slug of flush water directly behind and contiguous with each corrosion inhibitor slug for pushing that corrosion inhibitor slug into the well by opening a second valve upon closing of the first valve responsive to a second timer for insuring oil well corrosion inhibitor treatment on a regular basis as scheduled and for eliminating personnel time required for manually flushing each corrosion inhibitor throughout the oil well for an extended period of time.

12. A method as recited in claim 11 wherein the second method step comprises further, (a) ejecting the precise flush slug by operating a second valve responsive to a second timer immediately upon closing of the first valve.

13. A method for insuring well treatment on a regular basis as scheduled and for eliminating personnel time required for manually flushing slugs of a chemical throughout a well for an extended period of time comprising the steps of, (a) repeatedly ejecting precisely spaced apart consecutive predetermined precise slugs of a chemical to a well, and (b) repeatedly ejecting a predetermined precise slug of a flush liquid directly behind and contiguous with each chemical slug for pushing that chemical slug into the well by opening a second valve responsive to a second timer immediately upon closing of the first valve responsive to a first timer for insuring well chemical treatment on a regular basis as scheduled and for eliminating personnel time required for manually flushing each chemical slug throughout the well for an extended period of time.

* * * * *